US009599440B1

(12) United States Patent
Gish et al.

(10) Patent No.: US 9,599,440 B1
(45) Date of Patent: Mar. 21, 2017

(54) SYSTEMS AND METHODS FOR A CLOSE QUARTERS WEAPON

(71) Applicant: TASER International, Inc., Scottsdale, AZ (US)

(72) Inventors: Michael E. Gish, Phoenix, AZ (US); Dubravko Zekanovic, Phoenix, AZ (US)

(73) Assignee: TASER International, Inc., Scottsdale, AZ (US)

( * ) Notice: Subject to any disclaimer, the term of this patent is extended or adjusted under 35 U.S.C. 154(b) by 443 days.

(21) Appl. No.: 14/273,465

(22) Filed: May 8, 2014

Related U.S. Application Data

(60) Provisional application No. 61/970,561, filed on Mar. 26, 2014.

(51) Int. Cl.

| | |
|---|---|
| ***F41B 15/04*** | (2006.01) |
| ***F41H 13/00*** | (2006.01) |
| ***A41D 19/00*** | (2006.01) |
| ***A41D 1/00*** | (2006.01) |

(52) U.S. Cl.
CPC ..... *F41H 13/0018* (2013.01); *A41D 1/005* (2013.01); *A41D 19/0024* (2013.01)

(58) Field of Classification Search
USPC ..... 361/232
See application file for complete search history.

(56) References Cited

U.S. PATENT DOCUMENTS

| | | | | |
|---|---|---|---|---|
| 2,844,902 | A | 7/1958 | Gaylord | |
| 3,282,253 | A | 11/1966 | Ryan | |
| 3,448,541 | A | 6/1969 | Barlow | |
| 4,490,935 | A | 1/1985 | Plachy | |
| 5,062,230 | A | 11/1991 | Braverman | |
| 5,062,231 | A | 11/1991 | Braverman | |
| 5,282,332 | A | 2/1994 | Philips | |
| 5,986,872 | A | 11/1999 | Chaput | |
| 6,733,496 | B2 | 5/2004 | Ashley | |
| 7,221,552 | B1 | 5/2007 | Brown | |
| 7,984,579 | B2 | 7/2011 | Brundula | |
| 8,356,438 | B2 | 1/2013 | Brundula | |
| 8,837,107 | B2 | 9/2014 | Hinz | |
| 2004/0264099 | A1* | 12/2004 | Sikes | H05C 1/06 361/232 |
| 2011/0002077 | A1* | 1/2011 | Brundula | F41A 17/063 361/232 |
| 2011/0176250 | A1* | 7/2011 | Hinz | H01B 5/02 361/232 |
| 2012/0243141 | A1* | 9/2012 | Schweitzer | F41H 13/0018 361/232 |
| 2014/0022688 | A1* | 1/2014 | Jones | F41H 13/0018 361/232 |
| 2016/0216083 | A1* | 7/2016 | Russomanno | F41H 13/0018 |

FOREIGN PATENT DOCUMENTS

| | | |
|---|---|---|
| CN | 2151434 | 12/1993 |
| CN | 2187776 | 1/1995 |

* cited by examiner

*Primary Examiner* — Ronald W Leja

(74) *Attorney, Agent, or Firm* — Lawrence Letham

(57) ABSTRACT

Systems and methods for a close quarters weapon include disassembly of the weapon by the user to permit applying a stimulus signal for causing skeletal muscle contractions through tissue of a human or animal target between locations on the target that are independently determined by the user.

19 Claims, 9 Drawing Sheets

SYSTEMS AND METHODS FOR A CLOSE QUARTERS WEAPON

CROSS REFERENCE TO RELATED APPLICATIONS

This application claims the benefit under 119(e) of U.S. Provisional Patent Application Ser. No. 61/970,561 by Gish filed Mar. 26, 2014.

BRIEF DESCRIPTION OF THE DRAWING

Embodiments of the present invention will be described with reference to the drawing, wherein like designations denote like elements, and.

DETAILED DESCRIPTION OF THE PREFERRED EMBODIMENTS

Figure 1:
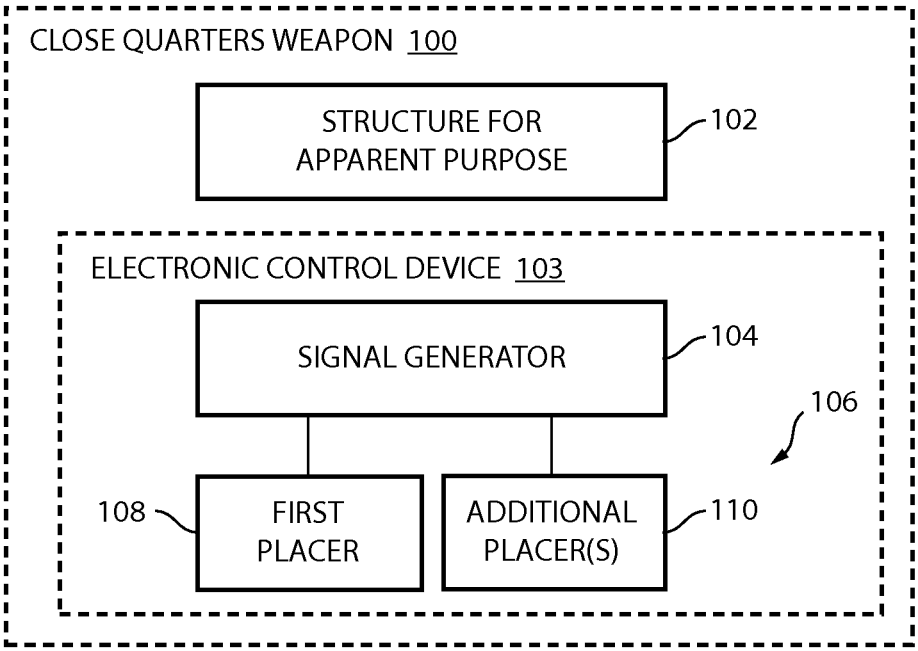
FIG. 1 is a functional block diagram of a close quarters weapon according to various aspects of the present invention.
Figure 2:
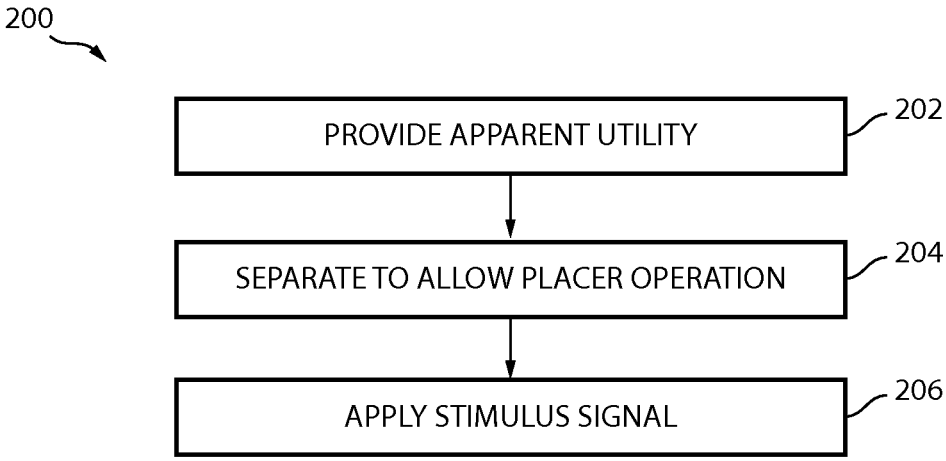
FIG. 2 is a flow chart of a method performed by the weapon of FIG. 1.

Close quarters battle includes hand-to-hand combat and weapons that may be deployed just prior to hand-to-hand combat. Conventional electronic control devices ("ECDs") provide a disabling current through a human or animal target to interfere with locomotion of the target by causing the skeletal muscles to contract while the current is present. ECDs are also known as stun guns, electrified projectiles, and conducted electrical weapons ("CEW"s). Examples of conventional ECDs include models X26, X2, X26P, and XREP marketed by TASER International, Inc. One form of conventional ECD, also called a stun gun, is not a gun in the sense of launching projectiles. Instead, the stun gun has terminals that, when placed against clothing or tissue of a target, cause a temporary disabling current to flow through target tissue. Generally, stun gun terminals are separated by a distance of only a few inches (e.g., 2 in. (5 cm)). Unless the temporary disabling current passes through a greater distance (e.g., greater than 6 in. (15 cm)) it is unlikely that locomotion will be halted.

A weapon for use in close quarters battle, herein called a close quarters weapon, according to various aspects of the present invention, produces a temporary disabling current through more than 6 inches of target tissue to accomplish halting of locomotion in human and/or animal targets. Electrical coupling to the target may be accomplished by piercing the skin with a conductive electrode, pressing a conductive terminal against the skin, and/or positioning an electrode within a distance from the skin and ionizing air between the electrode and the skin. In this later case, ionization may follow a path through clothing worn by the target. According to various aspects of the present invention, electrical coupling as discussed above is accomplished with a placer. While a single current path between two placers may be sufficient, multiple current paths may be implemented with the placement of more than two placers at any time (e.g., redundant paths, backup paths for paths that might be interrupted). The user of a close quarters weapon generally determines two or more locations for placers and positions placers at these locations. Positioning a placer may be by the user forcing contact between the placer and the target.

A placer includes any structure that performs one or more of the following functions for a close quarters weapon: conducting the temporary disabling current into target fluids by piercing the skin of the target (e.g., in a manner of the type used by a conventional ECD probe, spear, needle, electrode); conducting the temporary disabling current through skin (e.g., skin, hide, hair, fur) of the target (e.g., in a manner of the type used by a conventional abutting contact terminal, net, fluid, gel); supporting ionization from the placer to target skin (e.g., in a manner of the type used by pointed darts, diffusion structures); conducting the temporary disabling current after ionization; attaching to target tissue (e.g., in a manner of the type used by a conventional barbed spear, adhesive pad, adhesive gel); remaining in contact with skin (e.g., skin, hide, hair, fur) of the target or attaching to skin (e.g., skin, hide, hair, fur) of the target (e.g., in a manner of the type used with adhesive stickers, adhesive pads, bolo cords); remaining in contact with or attaching to clothing of the target (e.g., in a manner of the type including adhesives, barbed structures, structures for entanglement with fabric fibers). Positioning actions for more than one placer may be consecutive in time. Any number of placers may be located in a single action by the user. Positioning a placer may be accomplished by an act of the user (e.g., press, stab, thrust, push, jab) with one hand of the user.

The temporary disabling current is produced by a signal generator. A signal generator provides the current at a voltage. The initial voltage of a pulse of the current provided by the signal generator may be sufficient to ionize air in a gap between one or more placers. The average voltage of a pulse of the current may be relatively low (e.g., less than 400). A lower initial voltage may yet be sufficient to ionize air in a relatively small gap. Relatively low average voltages for each pulse may be used with placers that touch target tissue or embed in target tissue to provide the temporary disabling current. Unless otherwise indicated, a signal generator as discussed herein produces a conventional output current waveform (e.g., as used in ECDs marketed by TASER International, Inc.).

A close quarters weapon 100 of FIGS. 1-10 as discussed above includes a structure for an apparent purpose 102 and an electronic control device 103. Electronic control device 103 includes a signal generator 104 and a plurality of placers 106. At least two placers are needed to establish a circuit for conducting a temporary disabling current through one target. The plurality of placers 106 includes a first placer 108 and one or more additional placers 110.

A structure for an apparent purpose disguises the close quarters weapon. The appearance of the close quarters weapon may indicate an apparent purpose (e.g., identification badge, glove, ball point pen, pack of cigarettes, flashlight). The close quarters weapon may perform any function related to the apparent purpose (e.g., cooperate with conventional identification systems used for entering limited access facilities, protect the skin from abrasion or cold temperatures, dispense ink, contain unsmoked cigarettes, provide illumination). For example, the structure for an apparent purpose 102 inhibits recognition of the close quarters weapon as having any capability of a weapon. The structure for an apparent purpose 102 may be discarded prior to use of the close quarters weapon as a weapon. One or more placers of plurality 106 may include some or all of the structure for an apparent purpose 102, thereby contributing to disguising the placers 106 and the weapon 100.

For close quarters weapons that are not intended to be disguised, the structure for an apparent purpose may be omitted. A close quarters weapon of this type includes a signal generator 104 and a plurality of placers 106.

A method performed by close quarters weapon 100 includes separating portions of the weapon to permit application of the temporary disabling current through an effective distance of target tissue as discussed above. For example, method 200 of FIG. 2 includes providing apparent utility (202), separating to allow placer operation (204), and applying a stimulus signal (206).

Providing apparent utility is accomplished by a structure for an apparent purpose 102, discussed above. Providing apparent utility (202) may be performed before the other steps of method 200. In other implementations, providing apparent utility (202) may be performed during and/or after separating to allow placer operation (204) and/or applying a stimulus signal (206). In another implementation, discontinuing the providing apparent utility (202) is a prerequisite to other steps of method 200.

Separating to allow placer operation (204) is accomplished by packaging the close quarters weapon for quick disassembly by the user of at least one portion of the weapon from another portion of the weapon. Disassembly performed by the user may be reversible where the portions are configured to be reassembled after use. Disassembly may be irreversible (e.g., placers that penetrate target tissue are generally single use placers, the structure for apparent purpose is discarded or damaged by other steps of method 200). Disassembly may be accomplished by the user using one hand, for example, that retains a portion of the weapon while the separated portion comprising the first placer 108 attaches to the target. Disassembly may be accomplished by the user using two hands, for example, where the left hand and the right hand each manipulate a separated portion of the close quarters weapon. Disassembly preferably is accomplished without tools.

Separation enables the user to determine a respective location for positioning each placer. The user may be trained to operate the close quarters weapon for human and/or animal targets. Training may include specification of how much separation should be achieved (e.g., where separation is related to distance of temporary disabling current through target tissue). Training may include placement location recommendations (e.g., where current flow is not in a line between placers) such as one place on each of two appendages (e.g., thighs) where the non-linear current path is of sufficient distance. Trained users quickly determine suitable locations for positioning placers.

Applying a stimulus signal is accomplished by signal generator 104 and a plurality of placers 106, as discussed herein. A stimulus signal accomplishes skeletal muscle contractions for inhibiting (e.g., halting, deterring) locomotion as discussed above. Close quarters weapon 100 may apply a stimulus signal after a circuit is established through target tissue. Close quarter weapon 100 may include the capability of detecting when a circuit is established before activating a stimulus signal source. Detecting may be advantageous for power conservation for example, where detecting involves less energy than applying the stimulus signal. In an implementation where the close quarters weapon additionally includes a trigger, applying a stimulus signal may be responsive to operation of the trigger. In an implementation where placers are capable of supporting ionization to target tissue, the stimulus signal includes a voltage for a duration sufficient to accomplish ionization before providing the temporary disabling current. Applying continues generally until the purpose of the close quarters weapon is accomplished (e.g., time for the user to escape from the present location, time for disarming the target, time for confining or controlling the target with other restraints). Applying may be discontinued (e.g., target indicates an intent to comply with instructions) and later repeated (e.g., target indicates non-compliance).

A signal generator includes any structure capable of generating one or more signals to be applied through placers to target tissue. For example, signal generator 104 of FIG. 3 includes user controls 302, processing circuit 304, power supply 306, continuity detector 308, ionization signal source 310, stimulus signal source 312, and extendable wiring 314. In addition to the techniques discussed below, signal generator 104 may be constructed using conventional technologies to produce conventional signals to the plurality of placers 106 and receive conventional signals from the plurality of placers 106. These technologies are incorporated, for example, in the X26 ECD, X2 ECD, and XREP projectile marketed by TASER International, Inc.

User controls and displays 302 provide an apparatus for manual intervention and control of the operation of signal generator 104 by the user. Manual intervention by the user may be desired for changing the mode of signal generator operation. Where manual intervention and/or control is not necessary (e.g., automatic capabilities are sufficient), user controls and displays 302 may be omitted. User controls may include conventional components (e.g., switches, proximity detectors, membrane switches, toggle switches, touch panels, touch screens, buttons, latches, knobs, push buttons, spring-loaded push buttons, capacitive switches, levers, releasable electrical connectors) and be coupled to other portions of signal generator 104 with direct wiring or through a suitable wireless link supported by a transceiver (not shown) of signal generator 104. User controls may affect any one or more of the following: change of modes of operation of the signal generator (e.g., disabled, standby, armed, low power, full power); initiate and/or disable continuity detection; initiate and/or disable sourcing of an ionization signal; and initiate, continue, discontinue, and/or repeat sourcing of a stimulus signal.

When close quarters weapon 100 performs separating to allow placer operation (204), a control of user controls and displays 302 may operate and be recognized by processing circuit 304 to initiate any suitable function discussed herein. For example, when a user disassembles weapon 100, a releasable electrical connector may separate and processor circuit 304 initiate operation of the weapon in any conventional manner (e.g., enable and/or initiate applying stimulus signal (206)).

Displays of user controls and displays 302 may indicate any one or more of the following: readiness of a battery of power supply 306, readiness of processing circuit 304, status of processing circuit 304, status of continuity detector 308, status of ionization signal source 310, status of stimulus signal source 312, records kept by processing circuit (e.g., date/time of use, duration of use, parameters describing use, date/time of change of configuration settings, location of use (e.g., determined in any conventional manner such as GPS signal analysis)). Conventional time keeping, recording, locating, and display technologies may be used.

A power supply provides energy. A power supply may provide energy from a store of energy (e.g., battery, capacitor). Stored energy of a power supply may be depleted through use of the signal generator or imperfection of the store. Stored energy of a power supply may be renewed (e.g., recharged). A power supply may provide energy to a structure for an apparent purpose 102 to enhance disguising of close quarters weapon 100.

For example, power supply 306 provides energy to the circuits of signal generator 104. Power supply 306 provides energy to processing circuit 304, continuity detector 308, ionization signal source 310, and stimulus signal source 312. Power supply 306 may in addition provide energy for enhancing disguising close quarters weapon 100 (e.g., illuminate a light bulb of a flashlight, empower a camera, empower a transmitter to broadcast a message, empower a receiver to facilitate alerting the user).

A processing circuit includes any combination of hardware, firmware, and software suitable for a signal generator to perform applying a stimulus signal (206) as discussed above. A processing circuit may execute a program stored from memory of the processing circuit to execute any method performed by close quarters weapon 100. A processing circuit may measure and/or decode electrical signals, detect operation of user controls 302, control user displays 302, and determine physical characteristics and changes of physical characteristics of weapon 100 (e.g., effect of separating to allow placer operation (204)). A processing circuit may perform a function responsive to measuring, decoding, and/or analyzing indicia of changes as discussed above. A processing circuit may include conventional memory and microprocessor components, signal processors, transducers, analog-to-digital converters, and/or digital-to-analog converters. A processing circuit may include conventional communication circuitry and/or software for communicating with conventional systems (e.g., transfer of operations logs, changing a configuration of signal generator 104, installing firmware and/or software, determining date/time of use of weapon 100, determining location of weapon 100, reporting status and/or use of a weapon 100).

For example, processing circuit 304 cooperates with (e.g., controls, monitors, responds to) user controls and displays 302, continuity detector 308, ionization signal source 310, and stimulus signal source 312.

A continuity detector may determine whether or not suitable continuity exists between any two placers of plurality of placers 106 and provide indicia of continuity and/or control other functions of weapon 100. For example, continuity detector 308 sources and/or sinks current generally referred to as TEST SIGNALS in FIG. 3. Continuity detector 308 may provide a test voltage across a pair of placers of plurality of placers 106 and indicate presence of more than a threshold amount of current between the pair. The indication may enable and/or disable ionization signal source 310 and/or stimulus signal source 312 (as to the pair) directly or indirectly via additional logic (or program code) of processing circuit 304.

A conventional relatively low power technique may be used. When plurality of placers 106 includes more than two placers, continuity detector 308 (including suitable switching technology) and processing circuit 304 may cooperate to determine a preferred pair of placers for applying a stimulus signal (206). In response to an output of continuity detector 308, continuity detector 308 and/or processor circuit 304 may enable ionization signal source 310 (e.g., to attempt to establish continuity across an air gap between one or more placers 106 and target tissue), and/or enable stimulus signal source 312 (e.g., sufficient continuity exists). In an implementation where continuity detector 308 is omitted, ionization signal source 310 may be controlled by processing circuit 304 in response to other conditions (e.g., completion of separating to allow placer operation (204)).

Figure 3:
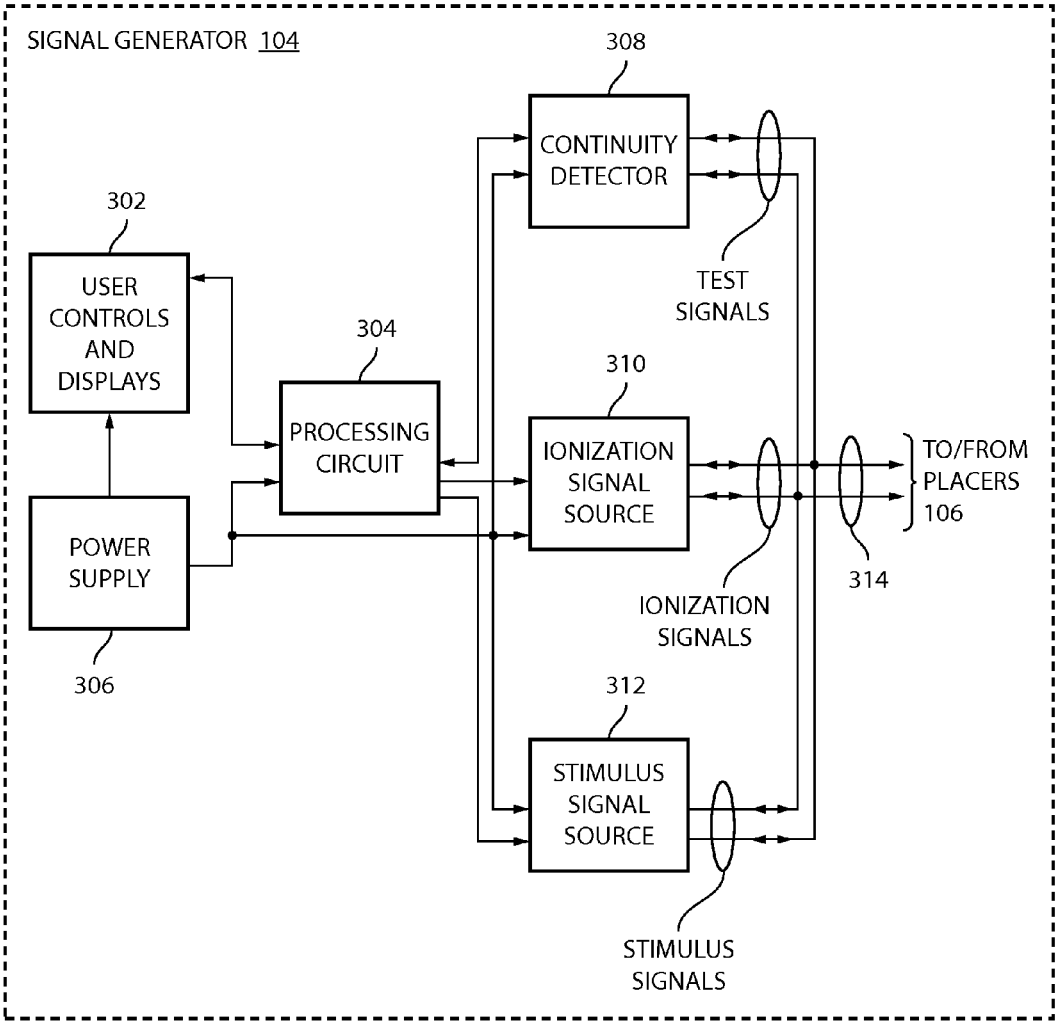
FIG. 3 is a functional block diagram of the signal generator of FIG. 1.

An ionization signal source provides signals generally referred to as IONIZATION SIGNALS in FIG. 3. Ionization signals have a voltage suitable for ionizing air for an expected distance that may exist between a placer and target tissue. For an air gap of about 1 in. (2.5 cm), about 25,000 volts is used. For example, ionization signal source 310 provides up to 50,000 volts to ionize gaps of total length up to 2 in. (5 cm) using conventional circuitry. In an implementation where ionization is not expected to be necessary (e.g., placers are expected to pierce target tissue), ionization signal source 310 is omitted. Ionization signals may be adjusted in response to monitoring of the type described in U.S. Pat. Nos. 7,457,096 and 7,986,506 to Brundula, assigned to TASER International, Inc.

A stimulus signal source provides a current at a voltage in a series of pulses generally referred to as STIMULUS SIGNALS in FIG. 3. The voltage suitable for stimulus as discussed above may depend on the capability and/or operation of placers of plurality of placers 106. For placers that penetrate target tissue, pulses having a peak voltage magnitude of about 400 volts are suitable. For placers that support ionization, one or more stimulus signal pulses may include an initial ionization voltage provided by ionization signal source 310. Stimulus signals may be adjusted in response to monitoring of the type described in U.S. Pat. Nos. 7,821,766 and 7,986,506 to Brundula, assigned to TASER International, Inc.

For example, stimulus signal source 312 receives energy at a relatively low voltage (e.g., 1-10 volts) from power supply 306, receives control signals from continuity detector and/or processing circuit 304 as discussed above, and provides a series of pulses via placers 106 through target tissue to cause contraction of skeletal muscles as discussed above. The stimulus signal may include pulses at a pulse repetition rate of 10-30 pulses per second for a duration of 10 to 30 seconds. Each pulse may deliver between 10 and 500 microcoulombs (preferably between 10 and 100 microcoulombs) of charge to target tissue. Processing circuit 304 may monitor the delivery of a pulse and adjust the characteristics (e.g., pulse width, amplitude of voltage, and/or amplitude of charge) of a next pulse so as to deliver a goal amount of charge into the target with each pulse.

Extendable wiring facilitates separating portions of close quarter weapon 100 to allow placer operation (204) for temporary disabling current along a path of suitable distance through target tissue. Extendable wiring may be coiled and stored in any portion of weapon 100.

For example, extendable wiring 314 electrically couples each placer to continuity detector 308, ionization signal source 310, and stimulus signal source 312. Where plurality of placers 106 includes more than two placers, suitable conventional electrical coupling may be used (e.g., switching circuits, spark gaps) The length of extendable wiring 314 may be minimal (e.g., 6 in. (15 cm) to 12 in. (30 cm)

preferably about 9 in. (23 cm)). Operator training may include instruction to separate portions of the weapon until the entire length is reached. To allow for sudden collapse of the target without defeating attachment of placers to target clothing or tissue, any suitable length of extendable wiring may be used, for example, from 36 in. (91 cm) to 60 in. (152 cm). Each extendable wire may be mechanically and electrically coupled to a placer and to a portion of weapon 100 using conventional technology (e.g., formed in a replaceable cartridge, equipped with reusable connectors).

Figure 4:
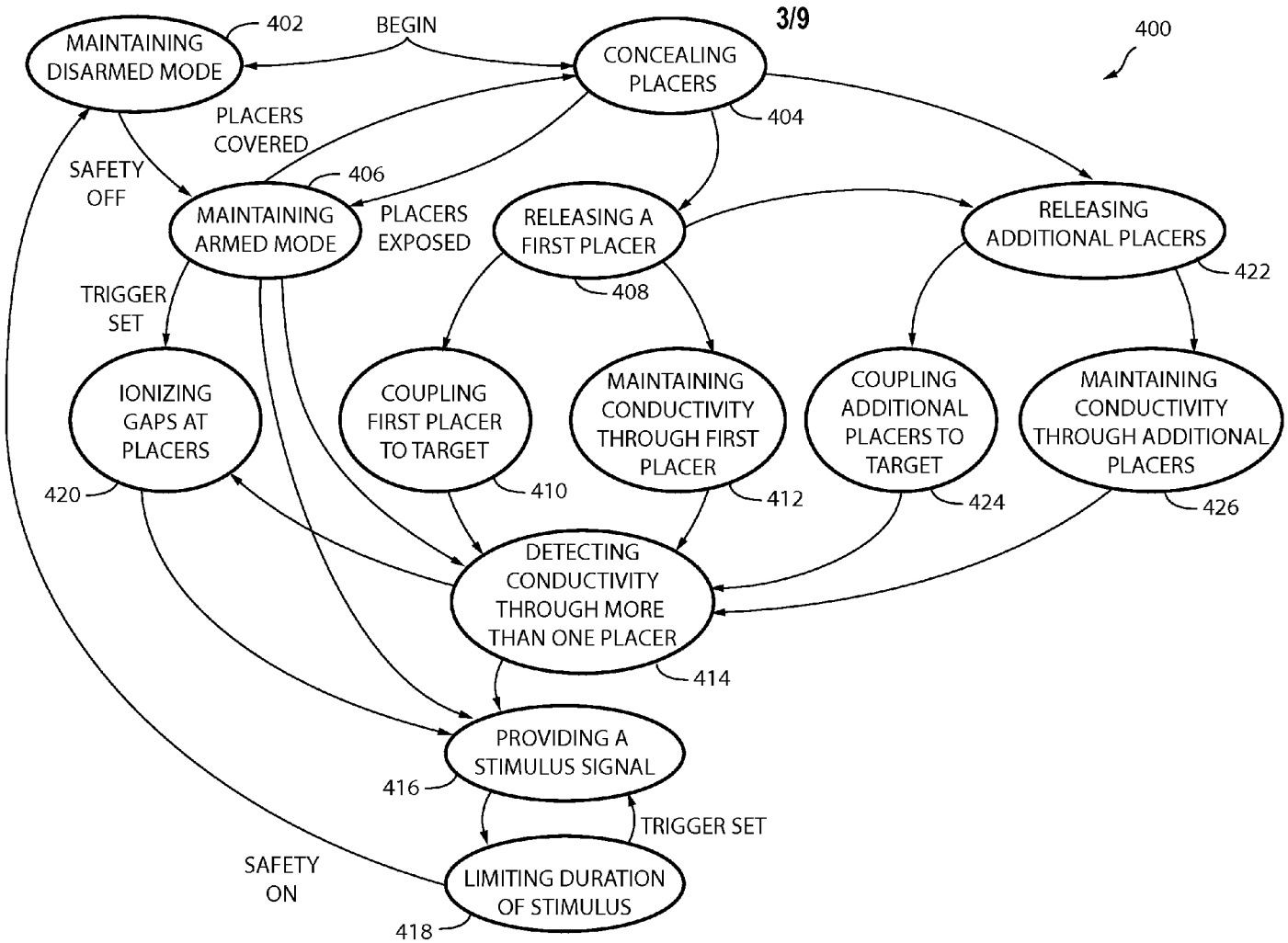
FIG. 4 is a process flow diagram of a method performed by the weapon of FIG. 1.
Figure 5A:
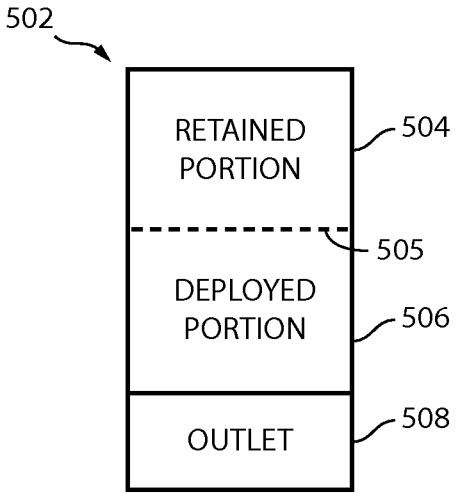
FIGS. 5A-5F are packaging plan diagrams for weapons according to FIG. 1.
Figure 5B:
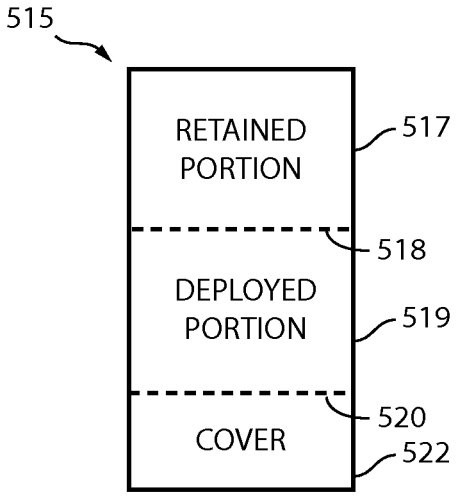
Figure 5C:
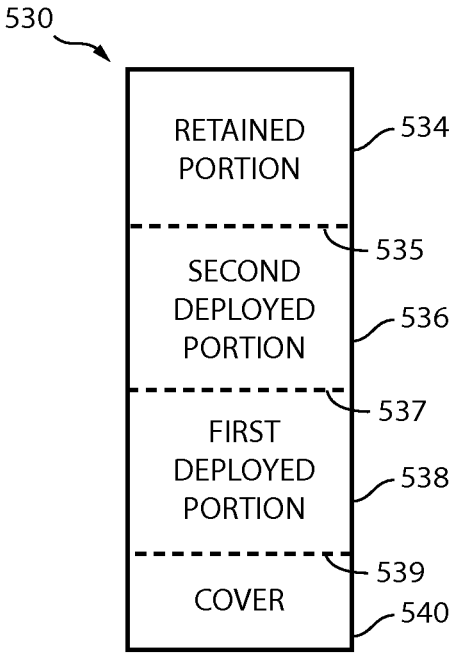
Figure 5D:
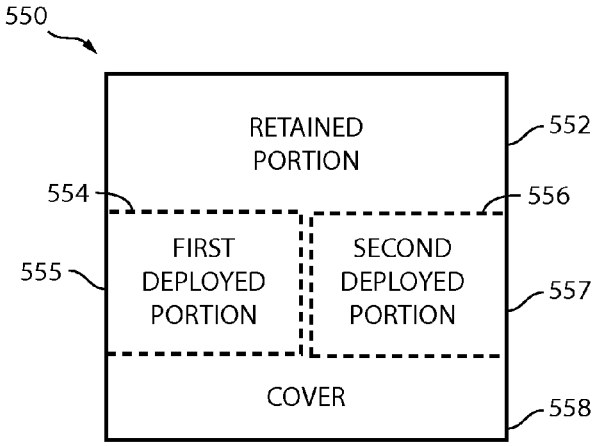
Figure 5E:
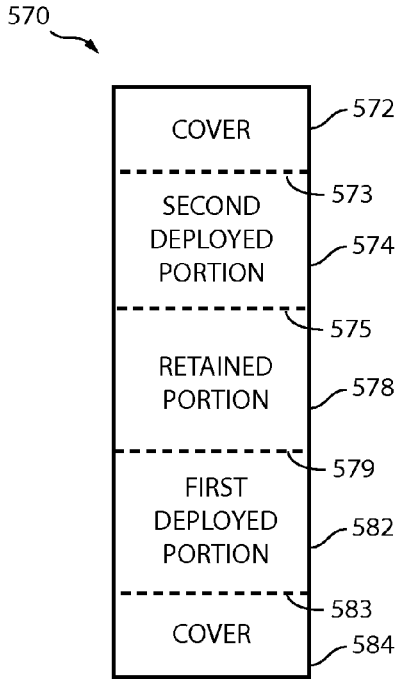
Figure 5F:
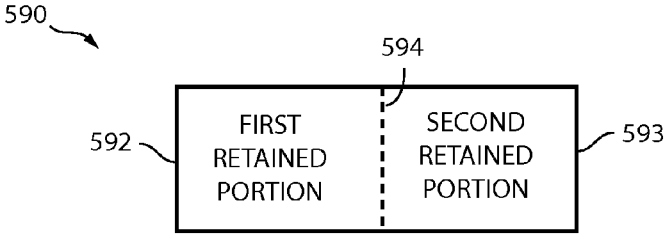
Figure 6A:
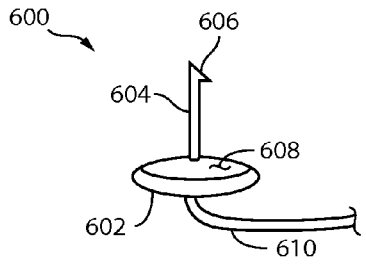
FIGS. 6A-6B are plan views of placers for weapons according to FIG. 1.
Figure 6B:
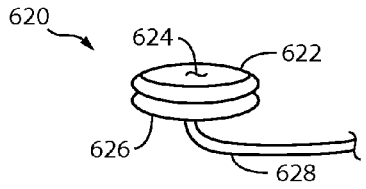

A close quarters weapon of the type discussed above may perform a method 400 for inhibiting locomotion of a human or animal target. Each step of the method may be performed whenever suitable conditions exist as detected in the step or as indicated by mechanical structures, interprocess relationships, and/or communication. For example, method 400 of FIG. 4 is performed by close quarters weapon 100 and includes maintaining disarmed mode (402), concealing placers (404), maintaining armed mode (406), releasing a first placer (408), coupling first placer to target (410), maintaining conductivity through first placer (412), detecting conduction through more than one placer (414), providing a stimulus signal (416), limiting duration of stimulus (418), ionizing gaps at placers (420), releasing additional placers (422), coupling additional placers to target (424), and maintaining conductivity through additional placers (426). These steps may be implemented to be performed by mechanical structures of weapon 100 and/or by processing circuit 304.

Method 400 is an implementation of a method of the type discussed above with reference to FIG. 2. In such an implementation, step 202 is implemented with steps 402 and 404. Step 204 is implemented with steps 408-412 and 422-426. Step 204 and/or 206 implement step 406. Step 206 is implemented with steps 414-420. Of course, other implementations of method 200 may not correspond to method 400. Some implementations of close quarters weapon 100 do not implement all steps of method 400, as will be discussed below.

By maintaining a disarmed mode (402) of operation, close quarters weapon 100 is safer for the user to handle without accidental activation of the signal generator. Power may be conserved by maintaining disarmed mode. A binary switch (e.g., enabling a power supply in response to detecting separation of weapon portions, detecting user operation of a safety switch), for example, as discussed above, may force performance of this step and otherwise force discontinuing performance of this step. For example, a safety switch set to "on" forces performance of this step; and the safety switch set to "off" discontinues performance of this step. In disarmed mode, separation of portions of weapon 100 may be inhibited (e.g., as a mechanical consequence of the safety switch being set to on). Maintaining disarmed mode may include providing periodic notice of a status of close quarters weapon 100 (e.g., that weapon 100 is available, is ready, requires recharging, has a change of status). Notice may be covert (e.g., haptic) and/or related to the structure for an apparent purpose 102 (e.g. disguised as wrist watch with an audible alarm used for notice).

Placers are concealed to maintain cleanliness of the placers and/or to disguise close quarters weapon 100. Concealing placers (404), is performed prior to a mission where the close quarters weapon is disguised and later deployed. Concealing placers continues until the weapon is prepared for immediate use. In an implementation where a placer is retained behind a cover so as to be concealed, removal of the cover discontinues this step; and replacing the cover may restart this step. When concealing placers is discontinued, maintaining armed mode (406), releasing first placer (408), and releasing additional placers (422) may be performed.

Weapon 100 maintains armed mode (406) after discontinuing the step of maintaining disarmed mode (402). Weapon 100 maintains armed mode (406) until deployed use of the weapon is no longer desired. In armed mode of operation, separation of portions of weapon 100 may be enabled and/or facilitated. Performing this step may enable, initiate, and/or continue performance of detecting conduction through more than one placer (414) and/or providing a stimulus signal (416).

In accordance with various aspects of the present invention, releasing a first placer (408) that is part of a first portion of weapon 100 may precede separating the first portion of weapon 100 from a second portion of weapon 100. Releasing allows at least two portions of weapon 100 to be separated. Releasing may be accomplished with disassembly of weapon 100 by the user.

For an implementation of weapon 100 that is operated by a user using only one hand, when the first placer is included in a portion of weapon 100 that is now separated from the remaining portion of weapon 100, the first placer remains in a position to conduct the stimulus signal through target tissue by being mechanically coupled (410) to clothing and/or tissue of the target. Suitable coupling is sufficient to support the weight of the placer and any forces that could dislodge the placer away from the coupled position. For example, a placer comprising a barbed spear may be manually implanted in target clothing and/or tissue by force of one arm of the user alone and the barb(s) of the spear perform coupling (410). In another implementation coupling (410) is accomplished or supplemented by propelling the placer toward the target at close range (e.g., releasing spring tension or releasing gas pressure).

After releasing the first placer (408), extendable wiring maintains conductivity through the first placer (412). In one implementation, one portion of weapon 100 comprising the first placer is attached to target clothing or tissue and extendable wiring maintains an electrical continuity from the placer in the first portion to a signal generator that is part of a second portion of weapon 100 that is now separated from the first portion. Because the wiring is extendable, the second portion may be moved away from the first portion to facilitate providing the temporary disabling current through a suitable distance of target tissue.

Weapon 100 performs detecting conduction through more than one placer (414) to conserve power (e.g. enable signal generation only when possible to deliver a signal through target tissue), and/or to improve effectiveness of weapon 100 where weapon 100 is equipped with more than two placers. Suitable conduction may be detected as discussed above with reference to continuity detector 308. When a placer is attached to target clothing, there is the possibility that the first two placers are not effective to cause contraction of most skeletal muscles (e.g., not in position with respect to target tissue, not positioned for suitable current path location (both in same appendage), not positioned for suitable current path distance). When each additional placer is coupled to target clothing or tissue, several pairs of placers potentially define current paths. By including a continuity detector, a pair with continuity is used for the stimulus signal.

Providing a stimulus signal (416) is accomplished by weapon 100 as discussed above with reference to FIGS. 1-3. Providing may include selecting a suitable pair of placers.

The stimulus signal is applied for a limited duration. To accomplish limiting the duration of the stimulus signal (418), a timer may be set and stimulus continued until lapse of the timer. The timer, if present, may be overridden and the duration cut short: by operation of a safety switch manually by the user, as discussed above; by removal of at least the second last operative placer manually by the user; or by reaching the end of available power for generating the stimulus signal. When the stimulus signal is no longer being applied, for any reason, maintaining disarmed mode (402) may recommence. If weapon 100 includes a trigger switch, manual operation of the trigger switch by the user may restart the timer and repeat applying the stimulus signal (416).

If the effectiveness of the close quarters weapon depends on placers being positioned in target tissue, then providing ionization is not required. In all other cases, the extent of desired ionization capability depends on the expected distance from each placer to target tissue and the expected skin resistance at that placer in the circuit from the signal generator through target tissue. Ionizing gaps at placers (420) is accomplished with a short duration high voltage between (or across) any suitable pair of placers for a short duration (e.g., less than 3 microseconds). Commencement of ionizing gaps at placers (420) may occur in response to manual operation of a trigger switch by the user when the weapon is currently maintaining armed mode (406) of operation. In other implementations, commencement of ionizing gaps at placers (420) may be responsive to failing to detect conduction (414) between placers during a suitable duration while maintaining armed mode (406), after releasing a first placer (408), after coupling a first placer to the target (410), or while maintaining conductivity through a first placer (412) (e.g., detecting that extendable wiring has been extended a suitable distance and/or for a suitable duration (allowing the user to let go of manually positioned placers to avoid experiencing a portion of the stimulus current)).

Generally, at least two placers are positioned on one target before conduction of the stimulus signal through that target's tissue. Weapon operation may include releasing additional placers (422). Releasing additional placers (422) may follow after discontinuing concealing placers (404), releasing a first placer (408), coupling the first placer to the target (410), or maintaining conductivity through the first placer (412). When the additional placer(s) is(are) part of one (or more) separable portion(s) of close quarters weapon 100 that is(are) separated from weapon 100 when positioned on the target, releasing (422) allows separation of placers by the user for the purpose of establishing at least one pair of placers at positions that exceed the minimum distance through target tissue for suitable effectiveness of the stimulus signal.

Weapon 100 may include placers for more than one target. For example, two placers may be used for each target. In another implementation, one placer is attached to each target and one placer is used with respect to each target at different times until conduction between targets can be established. Conductivity may be established for example by maintaining physical contact between targets, applying a conductive gel that spans the distance between the targets, and/or applying conductive handcuffs to one appendage of each target.

Coupling one or more additional placers to the target (424) may be accomplished for analogous purposes and in analogous manners as coupling the first placer to target (410) as discussed above.

Maintaining conductivity through additional placers (426) may be accomplished for analogous purposes and in analogous manners as maintaining conductivity through the first placer (412) as discussed above. Extendable wiring for maintaining conductivity (412, 426) may further allow the user to retain that portion of weapon 100 that is not released as the target falls away from the user under the influence of the stimulus signal.

Method 400 as discussed above may be accomplished in part with signal generator 104 as discussed above. Various implementations of signal generator 104 involve omitting one or more of the user controls and displays 302, continuity detector 308, and ionization signal source 310 and/or omitting particular functions of any of these functional blocks (e.g., switching logic for supporting more than two placers). Consequently, implementations of method 400 for these various signal generators permits the omission of some of the steps of FIG. 4 as discussed below or as will be apparent to one of ordinary skill in the art of stun guns in light of the teachings of this specification.

Concealing placers (404) may be omitted for implementations of weapon 100 that include other means for concealing weapon 100 and for implementations where disguising placers is not worth the cost, size, and/or weight of covers or other structure for an apparent purpose 102. For example, placers with outward facing attachment structures (e.g., ampules of adhesive, hooked fabrics for attaching to clothing) may be sufficiently unnoticeable and/or unrecognizable as placers, for instance, when supported on the band of a wrist watch.

Processing circuit 304 may omit logic supporting both a disarmed mode (402) and an armed mode (406) of operation. In effect, application of power from power supply 306 to processing circuit 304 may constitute an armed mode of operation and removal of that power may discontinue the armed mode leaving the weapon in a disarmed state as opposed to a disarmed mode of operation.

Ionizing gaps at placers (420) may be omitted in the absence of ionization signal source 310. Smaller enclosures for portions of close quarters weapon 100 may result.

Detecting conduction through more than one placer (414) may be omitted in the absence of continuity detector 308. Detecting conduction (414) by weapon 100 may be omitted, when the user follows operating instructions that make conduction highly likely. Detecting conduction (414) may be omitted when weapon 100 includes only two placers, for example, because no alternate paths are available to use instead of a path between the only two placers.

Releasing additional placers (422) and maintaining conductivity through additional placers (426) (e.g. with extendable wiring) may be omitted in an important class of implementations of close quarters weapons 100. In this class of weapons, the second placer is retained with the portion of weapon 100 that is not released with the first placer. For example, the user may press and hold the second placer against clothing or tissue of the target for the duration of the stimulus signal. A smaller close quarters weapon that is less complicated to operate may result.

Coupling additional placers to target (424) may be accomplished in the absence of releasing additional placers (422) by coupling a retained portion of close quarters weapon 100 to clothing or tissue of the target. In another implementation, hands-free control of weapon 100 may be maintained via a wireless link discussed above with reference to user controls and displays 302 and a suitable remote controller, retained by the user.

A close quarters weapon 100 according to various aspects of the present invention includes signal generator 104, first placer 108, and one additional placer 110 (structure for apparent purpose 102 being omitted). Such a weapon may perform steps 204 and 206 of method 200 of FIG. 2 (providing apparent utility (202) being omitted). Signal generator 104 of such a weapon may include power supply 306, processing circuit 304, and stimulus signal source 312 (user controls and displays 302, continuity detector 308 and ionization signal source 310 being omitted). Such a weapon may perform method steps 408, 410, 412, 416, and 418 (steps 402-406, 414, and 420-426 being omitted). In various other implementations of close quarters weapons 100 according to the present invention, one or more of the structures and/or method steps indicated as omitted are variously included so that the close quarters weapon includes structures and functions that are necessary to meet a user's requirements.

A close quarters weapon 100 includes the capability to be disassembled manually by the user preferably without tools. Disassembly permits the user to establish a distance between placers when at least one placer is part of a deployed portion of the weapon that is disassembled from a retained portion of the weapon; or between two retained portions. Several packaged close quarters weapons are discussed with reference to packaging plan diagrams of FIGS. 5A-5F. In the packaging diagrams, a shape of each portion is not shown in the plan diagrams; however, the relationship of one portion abutting another portion is indicated in the plan diagrams by adjacency. Adjacency in the packaging diagrams is not implied to be implemented only with complete physical adjacent portions but rather with physically adjacent portions that abut to an extent that the functions and benefits described for the adjacency are substantially met.

Each weapon 502, 515, 530, 550, 570, and 590 is a close quarters weapon of the type described above with reference to FIGS. 1-4. In each weapon package plan, the structure for apparent purpose 102 and the signal generator 104 may be part of one or more portions of the weapon. Disassembly of the weapon by the user for placement of placers on the target occurs at each mechanical interface 505, 518, 520, 535, 537, 539, 554, 556, 575, 579, 583, and 594. Each deployed portion may include a placer. When only one deployed portion is shown, the placer is a first placer 108. Extendable wiring 314 may extend across a mechanical interface to maintain conductivity (412, 426) from a placer to signal generator 104. For plans that include only one deployed portion, at least one additional placer 110 is included in a retained portion. If the outputs of signal generator 104 are located in a deployed portion, and a retained portion includes an additional placer, then extendable wiring 314 extends across the mechanical interface to maintain conductivity from the additional placer to signal generator 104.

A mechanical interface includes any structure that mechanically couples portions of a weapon together and is easily disassembled by the user to separate the portions from each other. Disassembly may be initiated and/or completed by the user (e.g., fully manual disassembly, manually initiated disassembly). Stored energy may simplify disassembly where the user initiates release of the stored energy and the stored energy performs all or some of the disassembly (e.g., user releases a torsion spring that unscrews a threaded coupling). Conventional releasable coupling techniques may be used (e.g., quarter turn, screw thread, bayonet, friction fit, snap, detents, latch). One or more coupling techniques may be implemented at a mechanical interface (e.g., each technique for a different separable portion). Disassembly may be destructive (e.g., single use weapon) or non-destructive to the mechanical interface. After disassembly, portions of the weapon are separable by release of stored energy (if any) and/or by manual movement of one or more portions by the user.

After releasing by the weapon 100 a portion of the weapon 100 from a mechanical interface, the user manually separates the deployed portion from other portion(s) of weapon 100. If the deployed portion performs coupling to the target (410 and/or 424) then separation of portions may occur before coupling (e.g. deployed portion is forced away from a retained portion), or during/after coupling (e.g. user moves retained portion away from coupled deployed portion, a mechanical interface supplies a force to separate portions). The force referred to may be provided by a release of spring tension or a release of compressed gas (e.g., opened canister and/or pyrotechnics). Weapons that include a force associated with separation may make controlling a target faster, easier, or more likely.

In operation, the user chooses a first location on the target for positioning first placer 108 and disassembles the weapon at a mechanical interface. The deployed portion of the weapon comprising the first placer 108 is ready for conducting the stimulus signal. Then, the user chooses one or more additional locations for positioning additional placers. Extendable wiring 314 may aid in the choice of locations for additional placers (e.g., extendable wiring marked for the user to easily determine a suggested sufficient distance, user trained to extend wiring to its maximum length before using or deploying another placer). Stimulus current is initiated by detecting conduction through more than one placer (414), after ionization (420) is expected to be established, and/or after a trigger switch is set by the user to "on".

An outlet includes any structure that conceals all or a portion of a placer, thereby inhibiting a target from recognizing a capability of the weapon 100. Deployment of a placer through an outlet does not require prerequisite disassembly of the weapon by the user but may include a mechanical operation to open the outlet (e.g., placer forced toward outlet opens outlet).

A cover includes any structure that conceals all or a portion of a placer, thereby inhibiting a target from recognizing a capability of a disguised weapon. Deployment of a placer concealed by a cover may follow disassembly of the weapon by the user to remove the cover. The cover may be mechanically coupled (e.g., tethered, hinged) to the weapon to avoid loss of the cover, or the cover may be discarded by the user after removal. Removal of the cover may facilitate coupling a placer to the target (410 or 424) and/or maintaining conductivity through the placer (412 or 426).

A retained portion of a weapon 100 includes any structure held in-hand by the user during some or all operations of the weapon.

Weapon 502 includes retained portion 504, deployed portion 506, and outlet 508. Deployed portion 506 separates from retained portion 504 at mechanical interface 505. Deployed portion 506 includes outlet 508. A first placer 108 is deployed through outlet 508 (e.g., deployed portion 506 is deformed by the user to push first placer 108 through outlet 508, a propellant activated by the user moves first placer 108 through outlet 508). Retained portion 504 includes at least one additional placer 110. Any face of retained portion 504 may operate to couple the at least one additional placer 110 to the target. In one example of operation, the user positions first placer 108 on the target defining a first location, extends extendable wiring 314 between deployed portion 506 and retained portion 504 so that retained portion 504 is proximate a second location on the target and there positions additional placer 110. Stimulus current then flows through target tissue as discussed above (414-420).

In one implementation of a weapon 502, the second placer contacts clothing or tissue of the target at (or via) interface 505. Deployed portion 506, prior to being disassembled from interface 505, may protect and/or conceal the second placer.

Weapon 515 includes retained portion 517, deployed portion 519, and cover 522. Cover 522 separates from deployed portion 519 at mechanical interface 520. Deployed portion 519 separates from retained portion 517 at mechanical interface 518. Deployed portion 519 includes first placer 108. Retained portion 517 includes at least one additional placer 110. Cover 522 disguises and/or protects first placer 108. Removal of cover 522 enables placement of first placer 108. Separation of deployed portion 519 from retained portion 517 enables placement of the at least one additional placer 110. Deployed portion 519 may perform the functions of a cover for the at least one additional placer 110. In one example of operation, the user disassembles cover 522 from weapon 515, positions first placer 108 on the target defining a first location, disassembles deployed portion 519 from retained portion 517, extends extendable wiring 314 from first placer 108 to a second location, and at the second location positions at least one additional placer 110 on the target. Stimulus current then flows through target tissue as discussed above (414-420).

Weapon 530 includes retained portion 534, second deployed portion 536, first deployed portion 538, and cover 540. Cover 540 separates from first deployed portion 538 at mechanical interface 539. First deployed portion 538 separates from second deployed portion 536 at mechanical interface 537. Second deployed portion 536 separates from retained portion 534 at mechanical interface 535. First deployed portion 538 includes first placer 108. Second deployed portion 536 includes at least one additional placer 110. Retained portion 534 may include one or more additional placers 110. Cover 540 disguises and/or protects first placer 108. Removal of cover 540 enables placement of first placer 108. Separation of first deployed portion 538 from second deployed portion 536 enables placement of placers 110 included in second deployed portion 536. First deployed portion 538 may perform the functions of a cover for the at least one additional placers included in second deployed portion 110. Second deployed portion 536 may perform the functions of a cover for any additional placers included in retained portion 534. In one example of operation, the user disassembles cover 540 from weapon 530, positions first placer 108 on the target defining a first location, disassembles first deployed portion 538 from second deployed portion 536, extends extendable wiring 314 from first placer 108 to a second location on the target, positions the at least one additional placer 110 from second deployed portion 536 at the second location, disassembles second deployed portion 536 from retained portion 534, and extends extendable wiring 314 from first placer 108 and/or second deployed portion 536 to facilitate retaining (holding in-hand) retained portion 534 independent of further movement by the target. If retained portion 534 includes additional placers 110, then the user may extend extendable wiring 314 from the first and/or second location on the target to a third location on the target and there position any additional placers from retained portion 534. Stimulus current then flows through target tissue as discussed above (414-420).

Weapon 550 includes retained portion 552, first deployed portion 555, second deployed portion 557, and cover 558. Cover 558 separates from first deployed portion 555 at mechanical interface 554 and from second deployed portion 557 at mechanical interface 556. First deployed portion 555 separates from retained portion 552 at mechanical interface 554. Second deployed portion 557 separates from retained portion 552 at mechanical interface 556. First deployed portion 555 includes first placer 108. Second deployed portion 556 includes at least one additional placer 110. Retained portion 552 may include one or more additional placers 110. Cover 558 disguises and/or protects placers of first and second deployed portions 555 and 557. Removal of cover 558 enables placement of placers of first and second deployed portions 555 and 557. Separation of first and second deployed portions 555 and 557 from retained portion 552 enables placement of placers included in retained portion 552 (if any). First and/or second deployed portions 555 and 557 may perform the functions of a cover for any additional placers included in retained portion 552. Separation of first deployed portion 555 from weapon 550 may enable placement of additional placers of second deployed portion 557 and/or retained portion 552. In one example of operation, the user disassembles cover 558 from weapon 550, positions first placer 108 on the target defining a first location, extends extendable wiring 314 from first placer 108 to a second location on the target, positions the at least one additional placer 110 from second deployed portion 557 at the second location, disassembles second deployed portion 557 from weapon 550, and extends extendable wiring 314 from first placer 108 and/or second deployed portion 557 to facilitate retaining (holding in-hand) retained portion 552 independent of further movement by the target. If retained portion 552 includes additional placers 110, then the user may extend extendable wiring 314 from the first and/or second location on the target to a third location on the target and there position any additional placers from retained portion 552. Stimulus current then flows through target tissue as discussed above (414-420).

Weapon 570 includes cover 572, second deployed portion 574, retained portion 578, first deployed portion 582, and cover 584. Cover 584 (572) separates from first (second) deployed portion 582 (574) at mechanical interface 583 (573). First (second) deployed portion 582 (574) separates from retained portion 578 at mechanical interface 579 (575). First deployed portion 582 includes first placer 108. Second deployed portion 574 includes at least one additional placer 110. Retained portion 578 may include one or more additional placers 110. Cover 584 disguises and/or protects first placer 108. Cover 572 disguises and/or protects the additional placer(s) 110. Removal of cover 584 (572) enables placement of first placer 108 (additional placer(s) 110). Separation of first deployed portion 582 and/or second deployed portion 574 from retained portion 578 enables placement of placers (if any) included in retained portion 578. First (second) deployed portion 582 (574) may perform the functions of a cover for any additional placers included in retained portion 578. In one example of operation, the user disassembles covers 584 and 572 from weapon 570, positions first placer 108 on the target defining a first location, disassembles first deployed portion 582 from retained portion 578, extends extendable wiring 314 from first placer 108 to a second location on the target, positions the at least one additional placer 110 from second deployed portion 574 at the second location, disassembles second deployed portion 574 from retained portion 578, and extends extendable wiring 314 from placers of the first and/or second deployed portions 582 and 574 to facilitate retaining (holding in-hand) retained portion 578 independent of further movement by the target. If retained portion 578 includes additional placers 110, then the user may extend extendable wiring 314 from the first and/or second locations on the target to a third location on the target and there position any additional placers from retained portion 578. Stimulus current then flows through target tissue as discussed above (414-420).

Weapon 590 includes first retained portion 592 and second retained portion 593 initially coupled together at mechanical interface 594. First retained portion 592 separates from second retained portion 593 at mechanical interface 594. First retained portion 592 includes first placer 108. Second retained portion 593 includes at least one additional placer 110. In one example of operation, the user separates the first and second retained portions from each other at mechanical interface 594, the user extends extendable wiring 314 between the separated portions, positions first placer 108 on the target defining a first location, and positions the additional placer 110 on the target defining a second location. Stimulus current then flows through target tissue as discussed above (414-420). The user may let go of one or both first and second retained portions prior to ionization and/or delivery of stimulus current.

In operation of a weapon (502, 515, 530, 550, 570, 590) that couples at least one retained portion (504, 517, 534, 552, 578, 592, 593) to clothing or tissue of the target, the user may let go of (stop manually retaining) one or more retained portions (504, 517, 534, 552, 578, 592, 593) to facilitate the user's actions to apply further restraints on the target (e.g., handcuffs) without interrupting the provision of the stimulus signal through target tissue.

A placer as discussed above may be implemented with a structure for mechanically coupling to clothing and/or tissue of the target. For example, placer 600 of FIG. 6A includes base 602 and spear 604. Placer 600 is mechanically and electrically connected to wire 610, which is part of extendable wiring 314. As another example, placer 620 of FIG. 6B includes base 626 and disc 622. Placer 620 is mechanically and electrically coupled to wire 628, which is part of extendable wiring 314.

A base of a placer includes any structure for supporting the functions of connecting the placer to clothing or tissue of a target and/or conducting the stimulus signal to or through tissue of the target. A base may be formed of metal, conductive plastic, or non-conductive plastic.

A disc of a placer includes any disc-shaped structure that provides a surface for connecting the placer to clothing or tissue of a target and/or conducting the stimulus signal to or through tissue of the target. A base may include a disc. A disc may be formed of metal, conductive plastic, or non-conductive plastic.

Base 602 includes surface 608 facing clothing or tissue of the target. Surface 608 may comprise structures of substances for mechanically and/or electrically coupling wire 610 to clothing or tissue of the target. For example, surface 608 may include adhesive, barbs or hooks for catching on fabrics, and/or conductive material (e.g., metallic fibers, gel, paste). Base 602 may mechanically secure one end of wire 610 to placer 600 in any conventional manner.

Spear 604 terminates at one end as tip 606 for mechanically and electrically coupling to clothing and/or tissue of the target. Spear 602 and tip 606 may be formed of stainless steel, or conductive plastic. Spear 604 may be formed from a conductor of wire 610. Spear 604 may be formed integrally with base 602.

Base 626 mechanically secures one end of wire 628 to placer 620 in any conventional manner. Base 626 supports disc 622. Disc 622 includes surface 624. Surface 624 may be structurally and functionally analogous to surface 608. Disc 622 may be replaceable to facilitate reuse of placer 620.

For placers that do not mechanically couple to clothing or tissue of the target, surface 624 may in use be pressed against target clothing or tissue and conduct the stimulus signal through target tissue by abutting target tissue or supporting ionization through target clothing. Retained portions held in the user's hand(s) during placement of placers 600 and 620 may be formed to facilitate a secure grip by the user and to reduce the possibility of stimulus signals passing through tissue of the user.

Extendable wiring 314 may be fully insulated, partially insulated, or not insulated. In one implementation, insulated extendable wiring 314 includes gaps in the insulation to provide or supplement the plurality of placers 106. Each gap is a placer.

Figure 7:
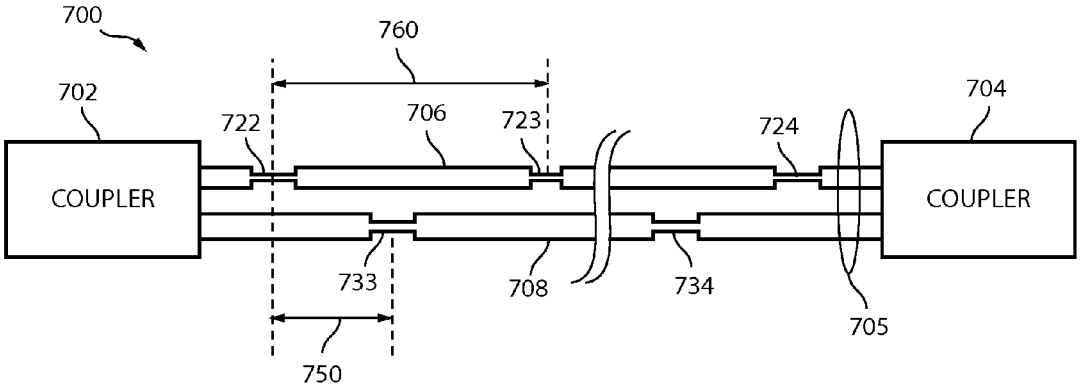
FIG. 7 is plan view of a system of placers according to various aspects of the present invention.

For example, plurality of placers 700 of FIG. 7 includes first coupler 702, second coupler 704, and wire pair 705. Wire pair 705 includes wire 706 and wire 708 that may be independent of each other or joined together along the entire distance between coupler 702 and 704.

Wire 706 includes gaps 722, 723, and 724 in its insulation. Wire 708 includes gaps 733 and 734 in its insulation. Wire 706 and 708 are of different electrical potentials so that a potential difference between gaps is sufficient to conduct the stimulus signal through clothing and/or tissue of the target. All gaps are made to assure that representative distance 750, from the midpoint of gap 722 to the midpoint of gap 733, are far enough apart to avoid ionization of air therebetween and far enough apart to assure effective delivery of the stimulus signal as discussed above. Distance 760, from the midpoint of gap 722 to the midpoint of gap 723 is representative of a pattern repeat distance made suitable for the shape and size of the target.

Each coupler 702 and 704 may be packaged as part of a deployed portion (e.g., 506, 519, 536, 538, 555, 557, 574, 582) or as part of a retained portion (e.g., 504, 517, 534, 552, 578, 592, 593). A deployed portion or a retained portion may further include other placers (e.g., 600, 620) as discussed above in addition to the gaps. A signal generator 104 may be packaged in one or more couplers.

A wire store includes any structure that stores wire to be extended during a deployment. A wire store may contain the wire prior to deployment. A wire store may aid in the deployment of the wire from the store so that the wire may extend from the wire store to the position of placement of a placer. A wire store may couple a wire to a signal generator or facilitate coupling of a wire to a signal generator for providing the stimulus signal through target tissue via the wire. A wire store may store one or more wires, for example, a wire store may store both wires 706 and 708.

Close quarters weapon 800 is an implementation of close quarters weapon 100. Close quarters weapon 800 performs the functions of a conventional glove and performs methods 200 and 400 in any suitable implementation discussed above. Close quarters weapon 800 is packaged according to the packaging plan of FIG. 5D except that cover 558 is replaced with a separate outlet (of the type discussed with reference to 508) for each deployed portion.

Figure 8:
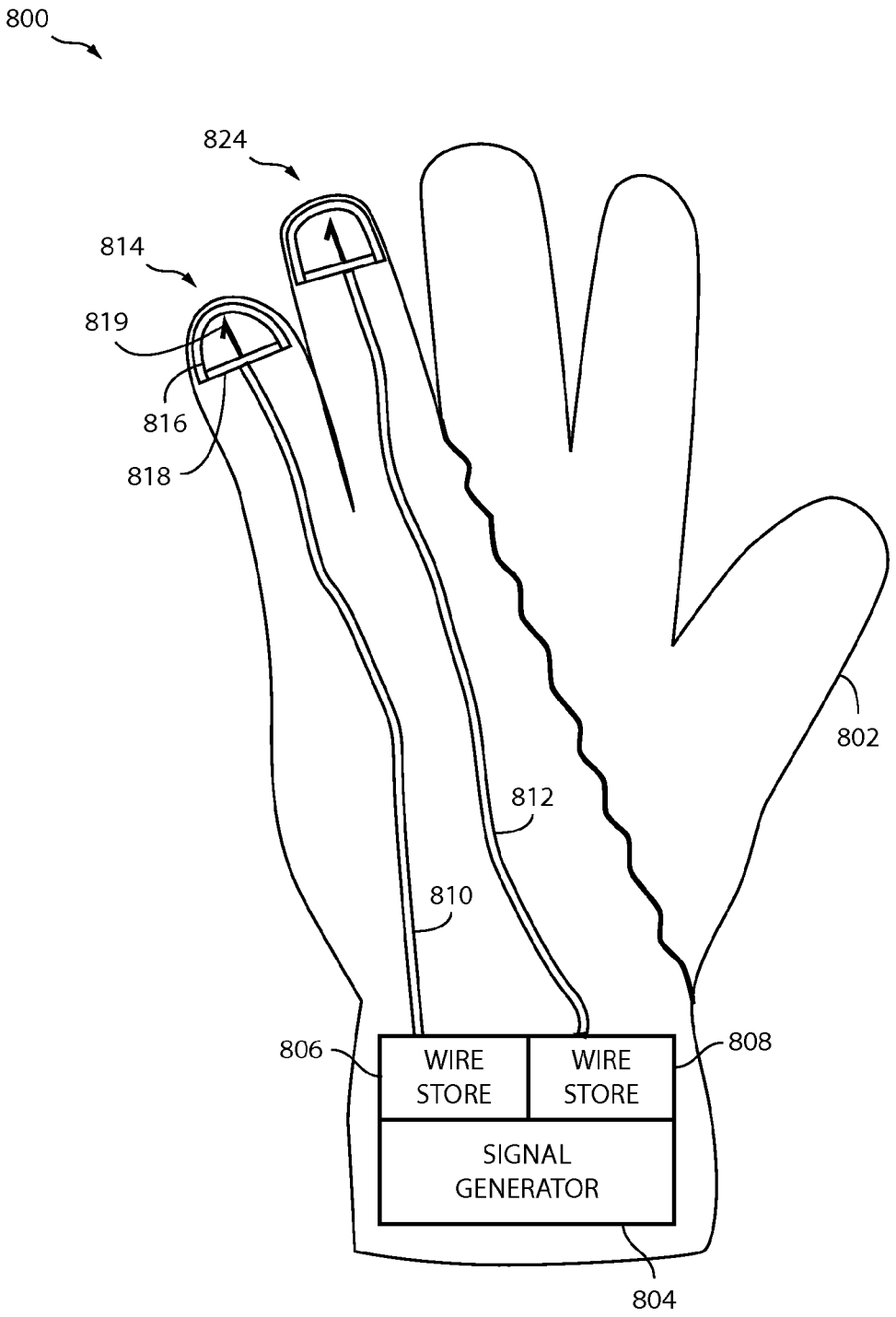
FIG. 8 is a cut away view of a close quarters weapon according to FIG. 1 formed for use as a glove.
Figure 9:
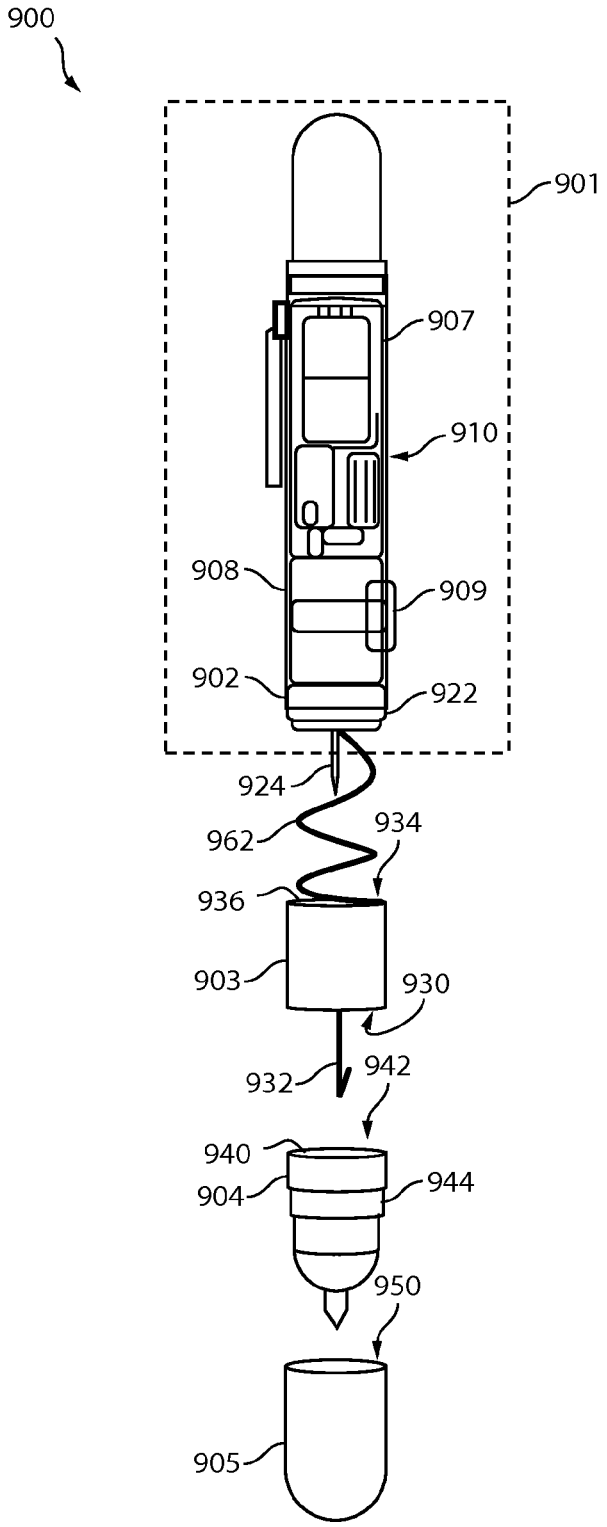
FIG. 9 is an exploded plan view of a close quarters weapon according to FIG. 1 formed for use as a ball point pen.
Figure 10:
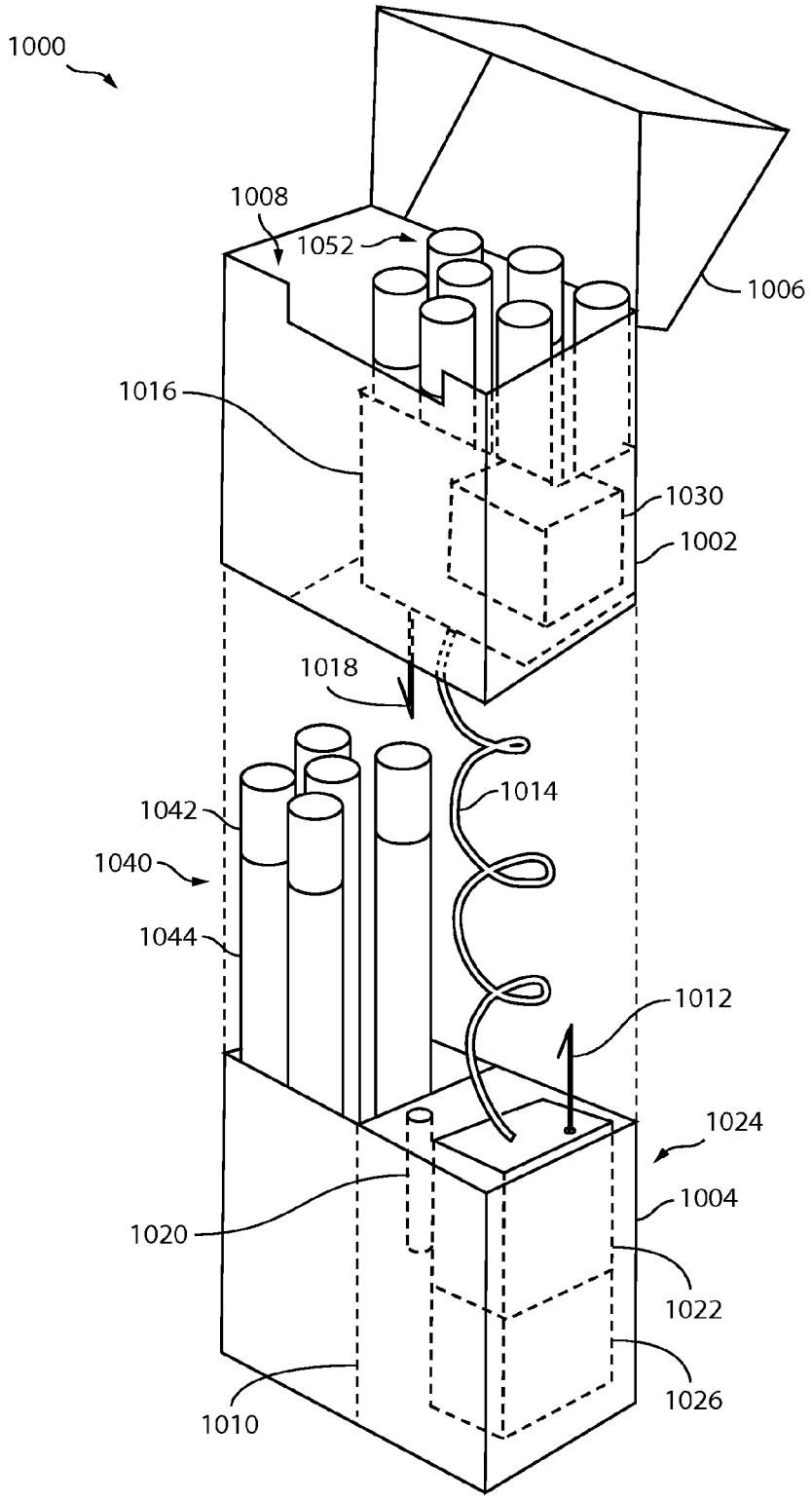
FIG. 10 is an exploded plan view of a close quarters weapon according to FIG. 1 formed for use as a cigarette pack.

Close quarters weapon 800 includes glove 802 formed of conventional fabric(s) for the user's right hand including a portion for each finger (thumb, forefinger, middle finger, ring finger, little finger) and a portion for the wrist, signal generator 804, wire stores 806 and 808, insulated wires 810 and 812, and placer assemblies 814 and 824 located in the ring finger tip and little finger tip of glove 802. FIG. 8 presents a cut away view of close quarters weapon 800 where most of the fabric for the left half of the palm is removed to show wires 810 and 812 located on the inside of the fabric that covers the back of the user's right hand.

Glove 802 is an implementation of structure for an apparent purpose 102. Location of placer assemblies 814 and 824 away from the thumb, forefinger, and middle finger facilitates use of the glove for a wide range of conventional purposes (e.g., picking up a clip board, using a pen).

A wrist portion of glove 802 supports and conceals signal generator 804 of the type discussed above with reference to signal generator 104 and wire stores 806 and 808 for extendable wiring of the type discussed above with reference to 314. Wire store 806 (808) stores un-deployed and excess wire 810 (812). Each wire 810 and 812 is electrically connected to signal generator 804.

Placer assembly 814 includes cap 816 and placer 818. Cap 816 covers tip 819 to keep tip 819 clean before deployment. Placer 818 is a placer of the type discussed above with reference to placer 600. Placer assemblies 814 (as an implementation of first deployed portion 555) and 824 (as an implementation of second deployed portion 557) are identical in structure and operation.

Placer assemblies 814 and 824 may move out of glove 800 through openings (not shown) conventionally formed in fabric 802 of the respective finger tips.

In one example of operation, a user of close quarters weapon 800 wears glove 802 on his or her right hand. To confront a target, the user determines a suitable first location on the target and presses little finger of glove 802 against clothing or tissue of the target. By pressing on placer 818 with the user's little finger, the user forces tip 819 through cup 816 and glove 802 thereby impaling target tissue through target clothing, positioning a first placer 108 at the first location. Quickly, the user then determines a suitable second location on the target. The user then moves glove 802 toward the second location and by doing so, extends wire 810 from wire store 806. The user presses the ring finger of glove 802 against clothing or tissue of the target at the second location. By pressing with the user's ring finger on placer assembly 824 in a manner analogous to operation of placer assembly 814, an additional placer 110 impales target tissue through target clothing at the second location. Stimulus current flows through target tissue as discussed above with reference to method 400. If the target falls away from the user (e.g., because the target's skeletal muscles are contracted and unworkable for balance) wires 810 and 812 may further extend from wire stores 806 and 808. Stimulus current continues to flow for a limited duration that may be suitable for the user to remove glove 802, apply handcuffs and/or shackles, cut wires 806 and 808 (e.g., to avoid traumatic removal of placers from tissue), and take the target into custody. In another example of operation, the user does not cut wires 806 and 808 so that operation of a trigger switch (not shown) of signal generator 804 may reapply the stimulus signal to ensure that other restraints on the target are effective.

Close quarters weapon 900 is an implementation of close quarters weapon 100. Close quarters weapon 900 performs the functions of a conventional ball point pen and performs methods 200 and 400 in any suitable implementation discussed above. Close quarters weapon 900 is packaged in accordance with the packaging plan of FIG. 5B.

Close quarters weapon 900 includes retained portion 901, extendable wiring 962, first deployed portion 903, ball point pen assembly 904, and cover 905. In a fully assembled configuration, first deployed portion 903 is friction fit onto retained portion 901 so that surfaces 922 and 936 nest; ball point pen assembly 904 is friction fit onto first deployed portion 903 so that surfaces 930 and 940 nest; and cover 905 is friction fit onto ball point pen assembly 904 so that surfaces 944 and 950 nest.

Retained portion 901 includes placer 902 and signal generator 910. Placer 902 is an implementation of the type discussed above with reference to placer 600 and is fixed in retained portion 901. Placer 902 is electrically coupled to signal generator 910. Placer 902 includes spear 924. Signal generator 910 (shown in a partial cut away view of weapon 900) is an implementation of the type discussed above with reference to signal generator 104. Signal generator 910 includes battery 908, trigger switch 909, and circuitry 907. Battery 908 is an implementation of power supply 306. Trigger switch 909 is an implementation of user controls 302 (displays being omitted). Circuitry 907 is an implementation of processing circuit 304 and stimulus signal source 312. In other implementations, circuitry 907 may further include continuity detector 308 and/or ionization signal source 310.

The exterior packaging and ball point pen assembly 904 are an implementation of structure for an apparent purpose 101. Close quarters weapon 900 has the appearance and functions of a conventional ball point pen, disguising its capabilities of a weapon.

First deployed portion 903 includes placer 932 and wire store 934. Wire store 934 stores un-deployed and excess wire 962. Wire 962 is electrically coupled to signal generator 910. Wire 962 is an implementation of the type discussed above with reference to extendable wiring 314.

In an example of operation, a user of close quarters weapon 900 holds weapon 900 in his or her right hand. To confront a target, the user removes cap 905 and ball point pen assembly 904. The user determines a suitable first location on the target and presses first deployed portion 903 against clothing or tissue of the target to impale tissue of the target. By pressing on first deployed portion 903, barbed spear 932 is retained in clothing and tissue of the target that allows deployed portion 903 to separate surfaces 934 and 922, consequently positioning a first placer 108 at the first location. Quickly, the user then determines a suitable second location on the target. The user then moves weapon 900 toward the second location and by doing so, extends wire 962 from wire store 934. The user presses retained portion 901 against clothing or tissue of the target at the second location. Consequently, placer 902 (serving as an additional placer 110) is positioned in target tissue. The user may at any time set trigger switch 909 to "on" to activate stimulus signal generator 910. The generated stimulus signal conducts through target tissue. Stimulus current flows through target tissue as discussed above with reference to method 400. Stimulus current continues to flow for a limited duration that may be suitable for the user to disarm the target, apply handcuffs and/or shackles, and take the target into custody. Trigger switch 909 may be operated to reapply the stimulus signal to ensure that other restraints on the target are effective. To reduce the possibility of trauma to target tissue related to the placement of placer 924, placer 924 may omit structure for coupling to clothing and/or tissue of the target. To reapply the stimulus signal, the user may determine an additional location and repeat pressing retained portion 901 against clothing or tissue of the target at the additional location before or during activation of signal generator 910.

Close quarters weapon 1000 is an implementation of close quarters weapon 100. Close quarters weapon 1000 performs the functions of a conventional cigarette pack and performs methods 200 and 400 in any suitable implementation discussed above. Close quarters weapon 1000 is packaged in accordance with the packaging plan of FIG. 5F except that in operation one or both retained portions may be released by the user, as discussed below.

Close quarters weapon 1000 includes first retained portion 1002, extendable wiring 1014, and second retained portion 1004. In a fully assembled configuration, first retained portion 1002 is friction fit onto second retained portion 1004 to achieve an overall rectangular appearance. Plurality of cigarettes 1040 occupies space 1008 and is fully enclosed when top 1006 is in a conventional closed position.

In weapon 1000, an implementation of structure for an apparent purpose 101 includes plurality of conventional cigarettes 1040, and plurality of faux filters 1052 having the appearance of filter portion 1042 of cigarette 1044 of plurality 1040. Close quarters weapon 1000 has the appearance and functions of a conventional cigarette pack, disguising its capabilities of a weapon.

First retained portion 1002 includes placer 1016 which may be of any type discussed above with reference to placers (106, 108, 600, 620, and 705). Placer 1016 includes barbed spear 1018. First retained portion 1002 further includes wire store 1030 that stores extendable and excess wire 1014 before separation of first retained portion 1002 and second retained portion 1004.

Second retained portion 1004 includes placer 1010 which may be of any type discussed above with reference to placers (106, 108, 600, 620, and 705). Placer 1010 includes barbed spear 1012. Barbed spear 1018 is covered in channel 1020 of placer 1010. Barbed spear 1012 is covered in an analogous channel (not shown) of placer 1016. Second retained portion 1004 further includes signal generator 1024. Placer 1016 is electrically coupled to signal generator 1024 via wire 1014. Placer 1010 is coupled to signal generator 1024 in any conventional manner.

Signal generator 1024 is an implementation of the type discussed above with reference to signal generator 104. Signal generator 1024 includes battery 1026 and circuitry 1022. Battery 1026 is an implementation of power supply 306. Circuitry 1022 is an implementation of processing circuit 304 and stimulus signal source 312. In other implementations, circuitry 1022 may further include continuity detector 308 and/or ionization signal source 310.

In an example of operation, a user of close quarters weapon 1000 holds weapon 1000 in his or her right hand. To confront a target, the user disassembles first retained portion 1002, held in the right hand, from second retained portion 1004, held in the left hand, consequently extending wire 1014 between the two portions. The plurality of cigarettes (if any) may be discarded. The user determines a suitable first location on the target and presses first retained portion 1002 against clothing or tissue of the target to impale tissue of the target. By pressing on first deployed portion 1002, barbed spear 1018 is retained in clothing and tissue of the target, consequently positioning a first placer 108 at the first location. Quickly, the user then determines a suitable second location on the target. The user then moves second retained portion 1004 toward the second location and by doing so may further extend wire 1014 from wire store 1030. The user presses retained portion 1004 against clothing or tissue of the target at the second location. Consequently, placer 1010 (serving as an additional placer 110) is positioned in target tissue. Stimulus current flows through target tissue as discussed above with reference to method 400. Stimulus current continues to flow for a limited duration that may be suitable for the user to hold the target in place, apply handcuffs and/or shackles, and take the target into custody. Barbed spears 1012 and 1018 (and adhesives of placers 1010 and 1016 (if any)) allow retained portions 1002 and 1004 to be released by the user (if and when desired) since they are consequently held in positions on clothing and/or tissue of the target.

In a first example, according to various aspects of the present invention, a close quarters weapon for provides a stimulus current through tissue of a human or animal. The weapon includes a stimulus signal source, a first placer, an additional placer, and extendable wiring. The stimulus signal source provides the stimulus current to cause contraction of skeletal muscles of the target. The first placer is coupled to the stimulus signal source. The additional placer coupled to the stimulus signal source. The extendable wiring that facilitates separation of the first placer and the additional placer. At least one of the first placer and the additional placer is coupled to the stimulus signal source via the extendable wiring. The weapon is configured to be disassembled manually by the user to permit the user to manually position both the first placer and the additional placer on the target and extend the extendable wiring, causing the stimulus current to flow through a distance of tissue of the target determined by the user.

In a second example, the close quarters weapon of the first example further includes a structure for an apparent purpose that conceals a capability of the close quarters weapon.

In a third example, the close quarters weapon of the first or second example further includes a continuity detector that activates the stimulus signal source in response to detecting continuity between the first placer and the additional placer.

In a fourth example, the close quarters weapon of the first, second, or third example further includes an ionization signal source coupled to the first placer and to the additional placer wherein at least one of the first placer and the additional placer is coupled to the ionization signal source via the extendable wiring.

In a fifth example, the close quarters weapon of any of the first through fourth examples further includes a processing circuit that controls at least one of the stimulus signal source, the continuity detector, and the ionization signal source.

A first exemplary method, performed by a close quarters weapon, includes the following steps in any practical order: (a) maintaining mechanical integrity of the weapon; (b) discontinuing maintaining mechanical integrity to allow a user of the weapon to separate a first deployed portion of the weapon from a retained portion of the weapon, the first deployed portion includes a first placer, the retained portion includes a second placer and a stimulus signal source; (c) maintaining continuity from the stimulus signal source to the first placer via extendable wiring of the weapon; and (d) providing a stimulus signal through a circuit includes the stimulus signal source, the first placer, the extendable wiring, and the second placer.

A second exemplary method, performed by a close quarters weapon, includes the following steps in any practical order: (a) maintaining mechanical integrity of the weapon; (b) discontinuing maintaining mechanical integrity to allow a user of the weapon to separate a first deployed portion of the weapon from a retained portion of the weapon, the first deployed portion includes a first placer for manually positioning by the user at a first location on the target determined by the user, and to separate a second deployed portion of the weapon from a retained portion of the weapon, the second deployed portion includes a second placer for manually positioning by the user at a second location on the target determined by the user after the first location has been determined, the retained portion includes a stimulus signal source; (c) maintaining continuity from the stimulus signal source to the first placer via first extendable wiring of the weapon; (d) maintaining continuity from the stimulus signal source to the second placer via second extendable wiring of the weapon; and (e) providing a stimulus signal through a circuit includes the stimulus signal source, the first placer, the first extendable wiring, the second placer, and the second extendable wiring.

A third exemplary method, performed by a close quarters weapon, includes the following steps in any practical order: (a) maintaining mechanical integrity of the weapon; (b) discontinuing maintaining mechanical integrity to allow a user of the weapon to separate the weapon into a first retained portion of the weapon and a second retained portion of the weapon, the first retained portion includes a first placer, the second retained portion includes a second placer and a stimulus signal source; (c) maintaining continuity from the stimulus signal source to the first placer via extendable wiring of the weapon; and (d) providing a stimulus signal through a circuit includes the stimulus signal source, the first placer, the extendable wiring, and the second placer.

In other example methods, any of the first, second, and third exemplary methods discussed above further includes concealing the first placer with a structure of the weapon, the structure being for an apparent purpose unrelated to ordinary functions of a weapon.

In other example methods, any of the first, second, and third exemplary methods discussed above further includes concealing the second placer with the first placer.

In other example methods, any of the first, second, and third exemplary methods discussed above further includes, prior to providing the stimulus signal, detecting conduction through the circuit.

In other example methods, any of the first, second, and third exemplary methods discussed above discontinuing maintaining mechanical integrity further allows the user of the weapon to separate a second deployed portion of the weapon from the retained portion, the second deployed portion includes a third placer; and the circuit comprises at least two of the first placer, the second placer, and the third placer.

In a sixth example, a close quarters weapon for inhibiting locomotion of a human or animal target, the weapon includes a structure for an apparent purpose; and an electronic control device that inhibits locomotion of the target by causing contraction of skeletal muscles of the target. In one variation, the structure for an apparent purpose comprises a container for cigarettes. In another variation, the structure for an apparent purpose comprises a ball point pen. In still another variation, the structure for an apparent purpose comprises a glove.

In a seventh example, the weapon of the sixth example further includes a placer; a signal generator; and extendable wiring that electrically couples the placer to the signal generator.

In an eighth example, the weapon of the sixth example releases the placer by disassembly of the weapon by the user.

In other examples, according to any previous example discussed above, the electronic control device includes a signal generator; and extendable wiring that electrically couples the signal generator to tissue of the target.

The foregoing description discusses preferred embodiments of the present invention, which may be changed or modified without departing from the scope of the present invention as defined in the claims. Examples listed in parentheses may be used in the alternative or in any practical combination. As used in the specification and claims, the words 'comprising', 'including', and 'having' introduce an open ended statement of component structures and/or functions. In the specification and claims, the words 'a' and 'an' are used as indefinite articles meaning 'one or more'. When a descriptive phrase includes a series of nouns and/or adjectives, each successive word is intended to modify the entire combination of words preceding it. For example, a black dog house is intended to mean a house for a black dog. While for the sake of clarity of description, several specific embodiments of the invention have been described, the scope of the invention is intended to be measured by the claims as set forth below.

What is claimed is:

1. A close quarters weapon for providing a stimulus current through tissue of a human or animal, the weapon comprising:

a stimulus signal source that provides the stimulus current to cause contraction of skeletal muscles of the target;

a first placer coupled to the stimulus signal source;

an additional placer coupled to the stimulus signal source; and extendable wiring that facilitates separation of the first placer and the additional placer; wherein at least one of the first placer and the additional placer is coupled to the stimulus signal source via the extendable wiring; and the weapon is configured to be disassembled manually by the user to permit the user to manually position both the first placer and the additional placer on the target and extend the extendable wiring, whereby the stimulus current flows through a distance of tissue of the target determined by the user.

2. The close quarters weapon of claim 1 further comprising a continuity detector that activates the stimulus signal source in response to detecting continuity between the first placer and the additional placer.

3. The close quarters weapon of claim 1 further comprising an ionization signal source coupled to the first placer and to the additional placer wherein at least one of the first placer and the additional placer is coupled to the ionization signal source via the extendable wiring.

4. The close quarters weapon of claim 3 further comprising a processing circuit that controls at least one of the stimulus signal source, the continuity detector, and the ionization signal source.

5. The close quarters weapon of claim 1 wherein:

the extendable wiring couples the stimulus signal source to the first placer; and the extendable wiring further couples the stimulus signal source to the second placer.

6. The close quarters weapon of claim 1 further comprising a trigger that facilitates control of the stimulus signal source by the user.

7. The close quarters weapon of claim 1 further comprising:

a retained portion comprising the stimulus signal source; and a first deployed portion comprising the additional placer, wherein the user manually disassembles the deployed portion from the retained portion.

8. The close quarters weapon of claim 1 further comprising a second deployed portion comprising a third placer, wherein the user manually disassembles the second deployed portion from the retained portion.

9. The close quarters weapon of claim 1 further comprising a cover that conceals at least one of the first placer, the additional placer, the stimulus signal source, and the extendable wiring thereby inhibiting the target from recognizing a capability of the close quarters weapon.

10. The close quarter weapon of claim 9 wherein the cover comprises a container for cigarettes.

11. The close quarter weapon of claim 9 wherein the cover comprises a ball point pen.

12. The close quarter weapon of claim 9 wherein the cover comprises a glove.

13. The close quarter weapon of claim 12 wherein at least one of the first placer and the additional placer is disassembled from a finger of the glove.

14. A weapon for providing a current through a human or animal target to interfere with locomotion of the target, the weapon comprising:

a signal generator that provides the current;

a first placer coupled to the signal generator;

a second placer coupled to the signal generator; and extendable wiring; wherein:

at least one of the first placer and the second placer is coupled to the signal generator via the extendable wiring;

the extendable wiring facilitates manual placement by the user of the first placer and the second placer on the target a distance apart from each other, the distance is determined by the user;

the weapon is configured to be manually disassembled by the user to permit the user to manually extend the extendable wiring to manually position the first placer and the second placer on the target the distance apart, whereby the current flows through the target via the first placer and the second placer to cause contraction of skeletal muscles of the target to interfere with locomotion of the target.

15. The weapon of claim 14 further comprising a cover, wherein the cover is at least partially removed from the weapon by the user to manually disassemble the weapon.

16. The weapon of claim 14 further comprising a cover, wherein the cover conceals at least one of the first placer, the second placer, the signal generator, and the extendable wiring thereby disguising the weapon.

17. The weapon of claim 14 further comprising a continuity detector that activates the signal generator in response to detecting continuity between the first placer and the second placer.

18. The weapon of claim 14 wherein the signal generator provides a pulse of the current at a voltage having a magnitude sufficient to ionize air in a gap between the target and at least one of the first placer and the second placer.

19. The weapon of claim 14 further comprising a processing circuit that controls an operation of the signal generator.

* * * * *